US007447322B2

(12) United States Patent
Harris, Jr. et al.

(10) Patent No.: US 7,447,322 B2
(45) Date of Patent: Nov. 4, 2008

(54) SPEAKER HAVING A TRANSPARENT PANEL

(75) Inventors: Kenneth David Harris, Jr., Hollis, NH (US); Vian W. Y. Li, Kowloon (HK); Timothy L. Trzepacz, Auburn, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 587 days.

(21) Appl. No.: 10/756,005

(22) Filed: Jan. 13, 2004

(65) Prior Publication Data

US 2005/0152564 A1 Jul. 14, 2005

(51) Int. Cl.
*H04R 25/00* (2006.01)

(52) U.S. Cl. ..... 381/152; 381/348; 381/353; 381/162; 381/395; 381/191; 181/151; 181/166

(58) Field of Classification Search ..... 381/86, 381/87, 99, 100, 117, 120, 152, 345, 347, 381/162, 386, 389, 395, 396, 407, 412, 423, 381/431

See application file for complete search history.

(56) References Cited

U.S. PATENT DOCUMENTS

| | | | | | |
|---|---|---|---|---|---|
| 3,578,104 | A * | 5/1971 | Sotome | ..... | 181/164 |
| 4,514,599 | A * | 4/1985 | Yanagishima et al. | ..... | 381/152 |
| 4,641,345 | A | 2/1987 | Takahashi | | |
| 5,297,212 | A * | 3/1994 | Murayama et al. | ..... | 381/86 |
| 5,824,969 | A * | 10/1998 | Takenaka | ..... | 181/156 |
| 5,901,231 | A * | 5/1999 | Parrella et al. | ..... | 381/86 |
| 6,031,926 | A | 2/2000 | Azima et al. | | |
| 6,095,280 | A * | 8/2000 | Proni | ..... | 181/171 |
| 2002/0118847 | A1* | 8/2002 | Kam | ..... | 381/111 |
| 2002/0191807 | A1* | 12/2002 | Asada et al. | ..... | 381/335 |
| 2003/0002695 | A1* | 1/2003 | Takahashi et al. | ..... | 381/111 |
| 2004/0047476 | A1* | 3/2004 | Sato | ..... | 381/89 |
| 2004/0240687 | A1* | 12/2004 | Graetz | ..... | 381/152 |
| 2006/0159293 | A1* | 7/2006 | Azima et al. | ..... | 381/152 |

FOREIGN PATENT DOCUMENTS

| | | |
|---|---|---|
| WO | WO 97/09858 A1 | 3/1997 |

(Continued)

OTHER PUBLICATIONS

International Search Report/PCT/US05/01926/mailed May 31, 2006.

*Primary Examiner*—Wayne Young
*Assistant Examiner*—Dionne H Pendleton
(74) *Attorney, Agent, or Firm*—Grossman Tucker Perreault and Pfleger

(57) ABSTRACT

A speaker having a transparent sound panel and an exciter connected to the transparent sound panel for converting electrical energy received by the exciter, into vibrations that are transmitted to the transparent sound panel, resulting in the transparent sound panel transmitting sound. The speaker also contains a stiff panel located between the exciter and the transparent sound panel, where the stiff panel minimizes dampening qualities associated with material utilized to fabricate the transparent sound panel and minimizes bending of the portion of the transparent sound panel that is in contact with the stiff panel. In addition, a dampening pad is located within the exciter for absorbing a portion of excessive mid-high frequency vibrations emanating from the exciter prior to transmission to the transparent sound panel.

17 Claims, 5 Drawing Sheets

FOREIGN PATENT DOCUMENTS

| | | | |
|---|---|---|---|
| WO | WO 97/09859 | A1 | 3/1997 |
| WO | WO 98/31188 | A1 | 7/1998 |
| WO | WO 98/34320 | A3 | 8/1998 |
| WO | WO 98/52383 | A1 | 11/1998 |
| WO | WO 99/02012 | A1 | 1/1999 |
| WO | WO 99/13684 | A1 | 3/1999 |
| WO | WO 99/65274 | A1 | 12/1999 |
| WO | WO 00/48428 | A2 | 8/2000 |
| WO | WO 01/45458 | A2 | 6/2001 |
| WO | WO 01/54450 | A2 | 7/2001 |

* cited by examiner

SPEAKER HAVING A TRANSPARENT PANEL

FIELD OF THE INVENTION

The present invention is generally related to audio speakers, and more particularly is related to a speaker having a transparent sound panel.

BACKGROUND OF THE INVENTION

Audio speakers have changed throughout time due to technological advancements and consumer perception of aesthetic appeal. Such technological advancements have led, for instance, to a decrease in the size of audio speakers and an increase in audio performance. As an example, while loud speakers still typically contain the same fundamental parts, namely, an electro-mechanical transducer (hereafter referred to as an "exciter") and a diaphragm or panel, certain loud speakers have become smaller in size and have increased in sound quality. In addition, certain loud speakers have changed in shape and color for aesthetic appeal.

FIG. 1 is a schematic diagram illustrating cross-sectional view of a typical loudspeaker 100. As is shown by FIG. 1, the loudspeaker 100 contains an exciter 112 and a speaker cone 122 having a diaphragm 124. As is known by those having ordinary skill in the art, the primary purpose of the exciter 112 is to convert received electrical energy into vibrations. As an example, conductive voice coils 114 located within the exciter 112 may be electrically connected to a device that is capable of transmitting electrical energy, such as an audio amplifier. When electrical energy interacts with a magnetic field provided by the exciter 112, the voice coils 114 vibrate. Vibration of the voice coils 114 results in the diaphragm 124 moving air to produce sound.

While advancements in technology have resulted in a decrease in size of typical loud speakers, the speaker is still clearly visible. Specifically, the exciter and the device used to produce sound, such as a speaker cone or panel, or any other device, is readily viewable. Unfortunately, while speakers may be made smaller in size so as not to have a large visual presence, they are still visually apparent, predominantly due to the speaker cone or panel.

Thus, a heretofore unaddressed need exists in the industry to address the aforementioned deficiencies and inadequacies.

SUMMARY OF THE INVENTION

Embodiments of the present invention provide a speaker having a transparent sound panel. Briefly described, in architecture, one embodiment of the speaker, among others, can be implemented as follows. The speaker contains a transparent sound panel and an exciter connected to the transparent sound panel for converting electrical energy received by the exciter, into vibrations that are transmitted to the transparent sound panel, resulting in the transparent sound panel transmitting sound. The speaker also contains a stiff panel located between the exciter and the transparent sound panel, where the stiff panel minimizes dampening qualities associated with material utilized to fabricate the transparent sound panel and minimizes bending of the portion of the transparent sound panel that is in contact with the stiff panel. In addition, a dampening pad is located within the exciter for absorbing a portion of excessive mid-high frequency vibrations emanating from the exciter prior to transmission to the transparent sound panel.

The present invention can also be viewed as providing methods for transmitting sound via a transparent sound panel. In this regard, one embodiment of such a method, among others, can be broadly summarized by the following steps: converting electrical energy into mechanical energy; absorbing a portion of excessive mid-high frequency vibrations prior to transmission to the transparent sound panel; and minimizing restriction of sound wave traversal throughout the transparent sound panel, prior to the sound wave traversal throughout the transparent sound panel.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a speaker having a transparent sound panel. It should be noted that, while the following describes different examples of material that may be used to provide the speaker having a transparent sound panel, one having ordinary skill in the art would appreciate that other material that would provide the transparent sound panel may be utilized. In addition, it should be noted that the present speaker may alternatively use the same material as mentioned herein, however with the material being colored or having a visual haze or non-clear portion. In addition, the material may be frosted or have a design painted, stained, or manufactured thereon.

Figure 1:
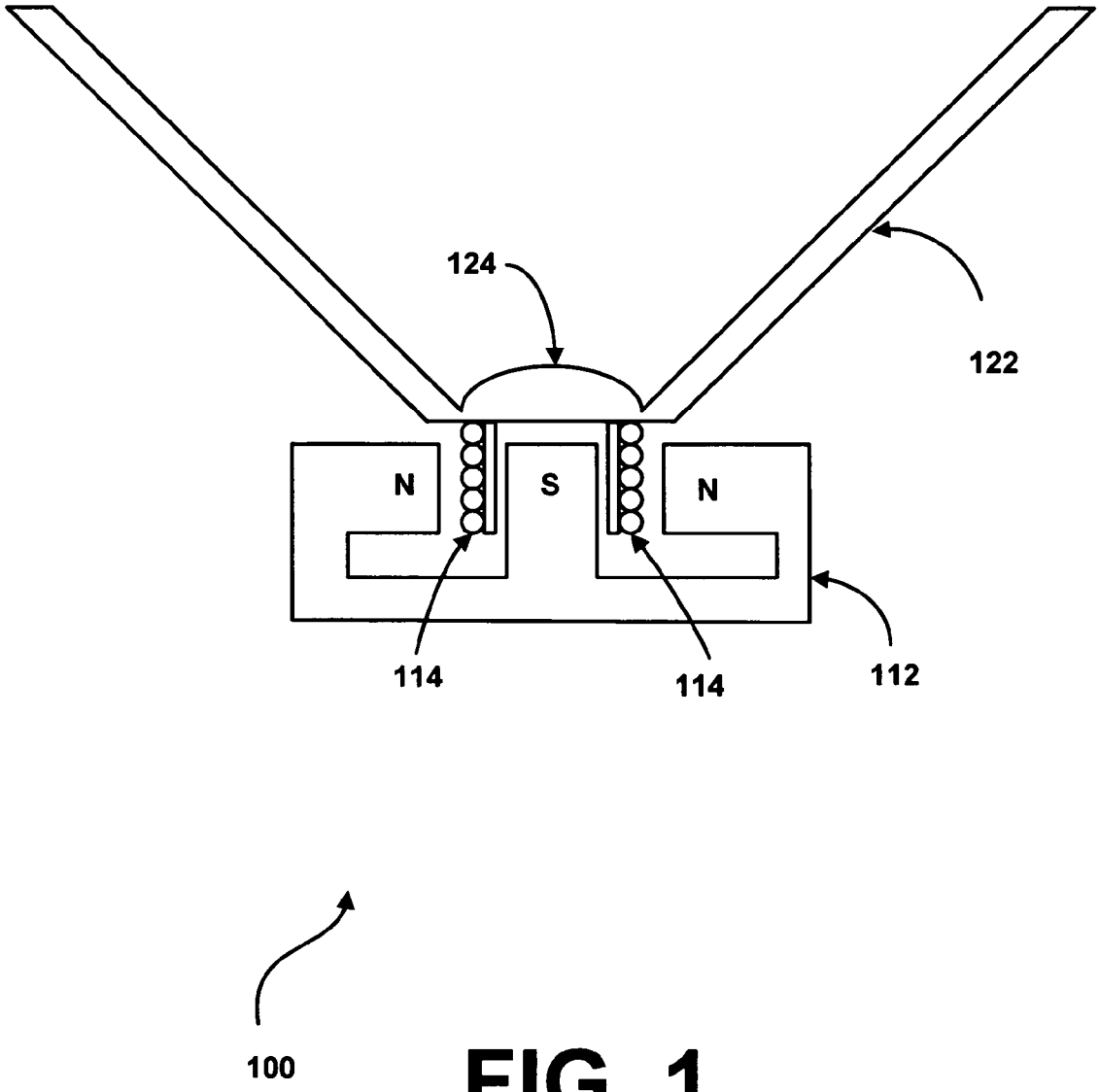
FIG. 1 (PRIOR ART)
FIG. 1 is a schematic diagram illustrating a cross-sectional view of typical loudspeaker.
Figure 2:
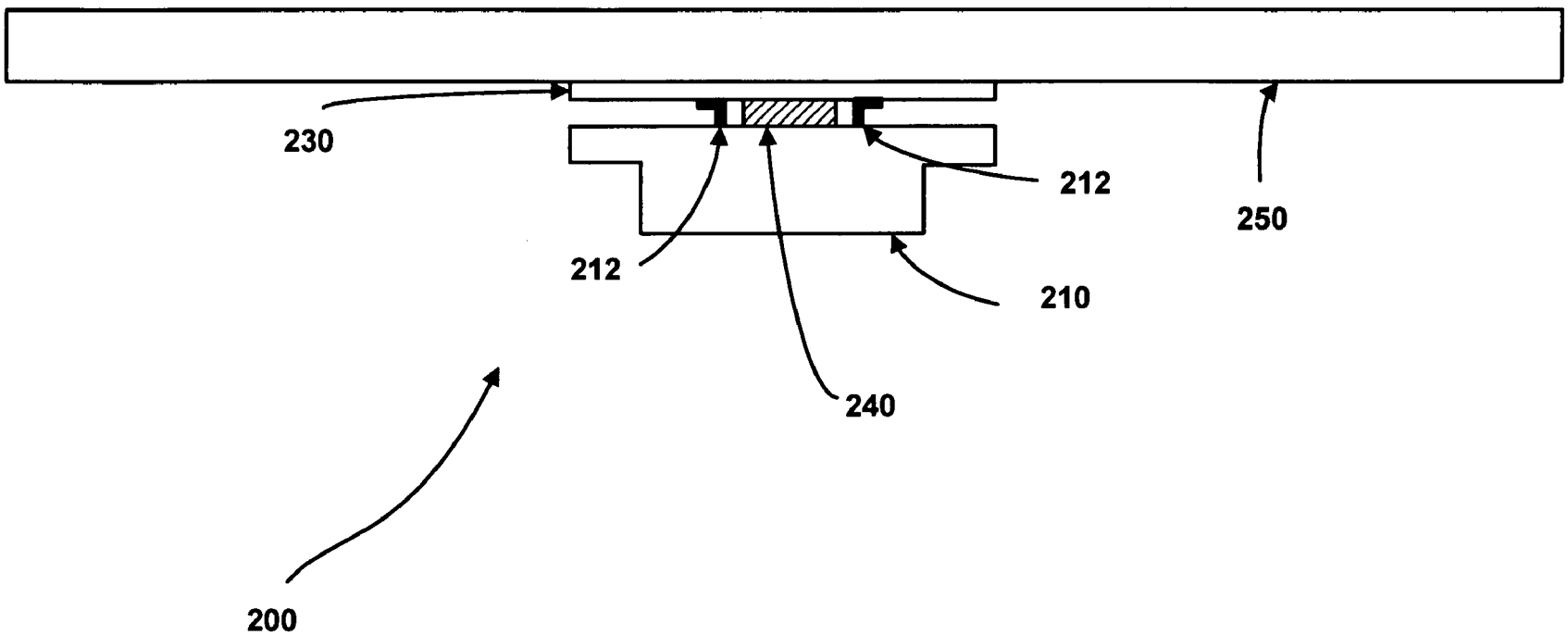
FIG. 2 is a schematic diagram providing a side view of the present speaker having a transparent sound panel, in accordance with a first exemplary embodiment of the invention.

FIG. 2 is a schematic diagram providing a side view of the present speaker 200 having a transparent sound panel 250, in accordance with a first exemplary embodiment of the invention. As is shown by FIG. 2, the speaker 200 contains an exciter 210 and a transparent sound panel 250. In addition, a stiff panel 230, which is made of a rigid material, may be located between the exciter 210 and the transparent sound panel 250. A dampening pad 240 may be located central to a voice coil 212 associated with the exciter 210. In addition, the dampening pad 240 is connected to the stiff panel 230. It should be noted that size of the dampening pad 240 and the stiff panel 230 might differ from that shown by FIG. 2.

In accordance with the first exemplary embodiment of the invention, the exciter 210 is preferably an electromechanical transducer that is capable of converting electrical energy received by the exciter 210 into mechanical energy, or vibrations. Conversion from electrical energy into vibrations by the exciter 210 is described and illustrated in more detail with reference to FIG. 3. In addition, one having ordinary skill in the art would know further details regarding an exciter that might be used within the present speaker 200. It should be noted that the exciter 210 might be one of many different types of exciters. As an example, the exciter 210 might be an electromagnetic exciter or a piezoelectric exciter.

Figure 3:
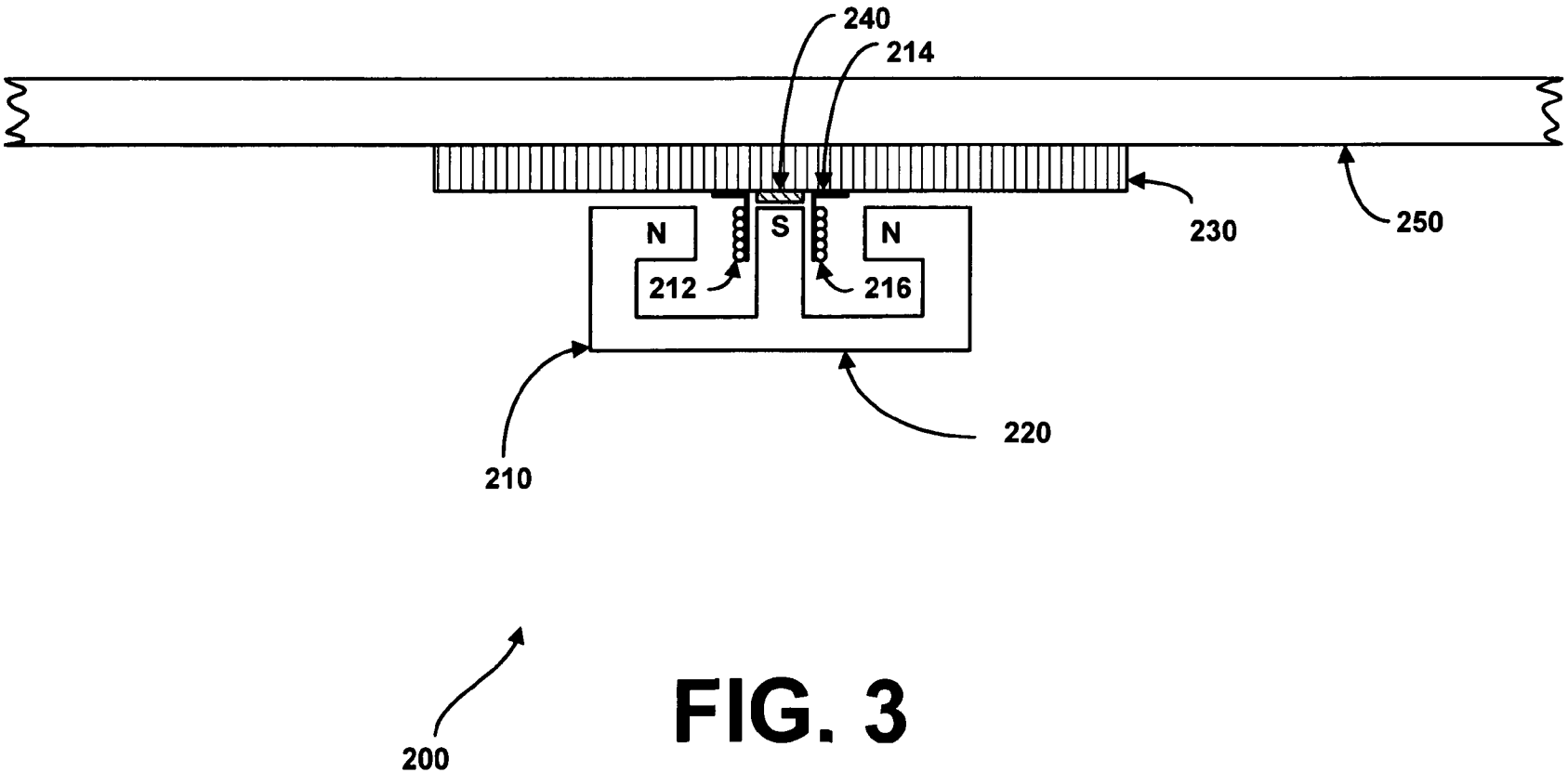
FIG. 3 is a schematic diagram further illustrating the speaker of FIG. 2.

FIG. 3 is a schematic diagram further illustrating the speaker 200 of FIG. 2. Specifically, FIG. 3 provides a cross-sectional view of the speaker 200 of FIG. 2. As mentioned herein above, the exciter 210 converts received electrical energy into vibrations. As is shown by FIG. 3, the exciter 210 contains the voice coil 212 and a magnetic structure 220. The voice coil 212 contains a cylindrical bobbin 214 and a coil of conductive wire 216, such as, but not limited to, copper wire. Terminals (not shown) of the voice coil 212 may be electrically connected to a device that is capable of transmitting electrical energy to the speaker 200, such as, but not limited to a driving device. As an example, the driving device may be an audio amplifier that is connected to the speaker 200. It should be noted that, while the present description describes one specific exciter design, one having ordinary skill in the art would appreciate that other exciters having a different configuration may be supplemented as long as the stiff panel 230 and dampening pad 240 may be utilized.

In accordance with the first exemplary embodiment of the invention, the magnetic structure 220 is a permanent magnet assembly that provides a constant magnetic field in a gap of the exciter 210 accommodating the voice coil 212. Specifically, magnetic attraction between north and south poles of the permanent magnet provides the constant magnetic field.

When electrical energy, such as current, is flowing through the voice coil 212, a magnetic field generated in the voice coil 212 interacts with the magnetic field of the magnetic structure 220. This interaction results in an upward and downward vibration motion of the voice coil 212, frequency of which depends on waveform of the received electrical signal. It is based upon this vibration motion that the received electrical energy is converted into mechanical energy. Specifically, as is described in more detail below, since the transparent sound panel 250 is connected to the exciter 210, via the stiff panel 230, with the dampening pad 240 located therebetween, vertical motion of the voice coil 212 drives the transparent sound panel 250 to vibrate according to the received electrical signal. This process is also referred to herein as the exciter 210 exciting the transparent sound panel 250.

When the exciter 210 excites the transparent sound panel 250, the transparent sound panel 250 does not vibrate in a pistonic motion. Instead, up and down motion of the sound panel 250 is not simultaneous at every point on the sound panel 250. The result of excitation of the transparent sound panel 250 is vibration of the transparent sound panel 250 in a wave-like motion. Specifically, vibration of the transparent sound panel 250 begins at the voice coil 212 and traverses through the stiff panel 230, to a point on the transparent sound panel 250, where the vibration traverses the transparent sound panel 250 in a wave-like motion away from the originating point of the transparent sound panel 250.

The transparent sound panel 250 may be made of many different materials. As an example, the transparent sound panel 250 may be made of acrylic, polycarbonate, polypropylene, or polyvinyl chloride (PVC). It should be noted, however, that the transparent sound panel 250 may instead be made of a different transparent material known by those having ordinary skill in the art. In addition, as mentioned above, the material utilized to fabricate the transparent sound panel 250 may alternatively be colored, have a visual haze, be frosted, or have a design painted, stained, or manufactured thereon.

The stiff panel 230 located between the exciter 210 and the transparent sound panel 250 provides improvement in high frequency output of the speaker 200 having the transparent sound panel 250, without requiring an increase in electrical energy input. Specifically, without the stiff panel 230, high frequency output of the speaker 200 may not be adequate for high fidelity sound quality because the material used to create the transparent sound panel 250 usually has dampening properties that cause absorption of excessive high frequency energy, thereby resulting in restricting high frequency sound waves from traversing the transparent sound panel 250 to an edge of the transparent sound panel 250. Therefore, a user of the speaker 200 will hear a dull sound reproduction. Since minimizing restriction of sound wave traversal throughout the transparent sound panel 250 would result in improvement in high frequency output of the speaker 200, such minimizing is desirable. Of course, a different material may be used to fabricate the transparent sound panel 250, where the different material is not burdened with inadequate high frequency output of the speaker 200.

It should be noted that, in accordance with the first exemplary embodiment of the invention, the dampening pad 240 is located on the portion of the stiff panel 230 that is attached to the exciter 210. In addition, it is preferred that the dampening pad 240 has a diameter that is smaller than a diameter of the voice coil 212. As a result, the voice coil 212 does not drive the stiff panel 230 through the dampening pad 240. Instead, the function of the dampening pad 240 is to absorb excessive high frequency energy generated by the stiff panel 230 within the diameter of the voice coil 212. In addition, the dampening pad 240 does not absorb the excessive high frequency energy from other areas of the stiff panel 230. An example of material that may be used to fabricate the dampening pad 240 is rubber. Of course, other dampening materials having functionality similar to that disclosed herein may be used.

The stiff panel 230 stiffens the connection between the exciter 210 and the transparent sound panel 250. Stiffening the connection area between the exciter 210 and the transparent sound panel 250 minimizes dampening qualities associated with the material utilized to fabricate the transparent sound panel 250, thereby minimizing restriction to vibration of the transparent sound panel 250. As a result of this addition, high frequency energy loss associated with the connection between the exciter system 210 and the transparent sound panel 250 is reduced since bending of the portion of the transparent sound panel 250 that is in contact with the stiff panel 230 is minimized by the stiff panel 230.

The stiff panel 230 is preferably located between the transparent sound panel 250 and the dampening pad 240. As mentioned above, the stiff panel 230 is attached to the transparent sound panel 250, the dampening pad 240, and the cylindrical bobbin 214. It should be noted that the stiff panel 230 may be attached to the transparent sound panel 250, the dampening pad 240, and the cylindrical bobbin 214 via different means, such as, but not limited to, use of an adhesive, clamps, screws, or any other attachment means known by those having ordinary skill in the art.

As is shown by FIG. 3, the dampening pad 240 is attached to a central location of the stiff panel 230. In addition, the dampening pad 240 is preferably located within the cylindrical bobbin 214, yet not touching the exciter 210. It should be noted that the dampening pad 240 may be attached to the stiff panel 230 via different means, such as, but not limited to, use of an adhesive, clamps, screws, or any other attachment means known by those having ordinary skill in the art.

The dampening pad 240 is preferably located at the middle of the exciter system 210, where the dampening pad 240 can absorb a portion of excessive mid-high frequency energy from the exciter 210 that emanates to a listener. Since the dampening pad 240 does not affect energy transfer from the voice coil 212 to an edge of the transparent sound panel 250, the dampening pad 240 optimizes the total amount of high frequency output of the speaker 200. Therefore, by absorbing a portion of excessive mid-high frequency vibrations prior to transmission to a central portion of the transparent sound panel 250, use of the dampening pad 240 results in a smoother sound being transmitted from the speaker 200. Specifically, use of the dampening pad 240 results in high pitch sound transmitted from the speaker 200 having less overshoot in waveform of the speaker 200. Therefore, decay of high pitch vibration of the speaker 200 is faster after a received electrical signal is stopped.

It should be noted that, although in describing the speaker 200, the term "loud speaker" has been used as a convenient nomenclature, it will be understood that this should not be read as a limitation to, as an example, hi-fi speakers alone. Rather, the invention is applicable across a range of speaker sizes from the smaller scale to the very large. In addition, the exciter 210 may connect to a location of the transparent sound panel 250 that is not central to the panel 250. As an example, the exciter 210, stiff panel 230, and dampening pad 240 may be located on an edge of the transparent sound panel 250. In addition, the dampening pad 240 may be located in a location that is not central to the diameter of the voice coil 212. Instead, the dampening pad 240 may be located between the stiff panel 230 and the voice coil 212 so that the dampening pad 240 is connected to both the stiff panel 230 and the voice coil 212.

Figure 4:
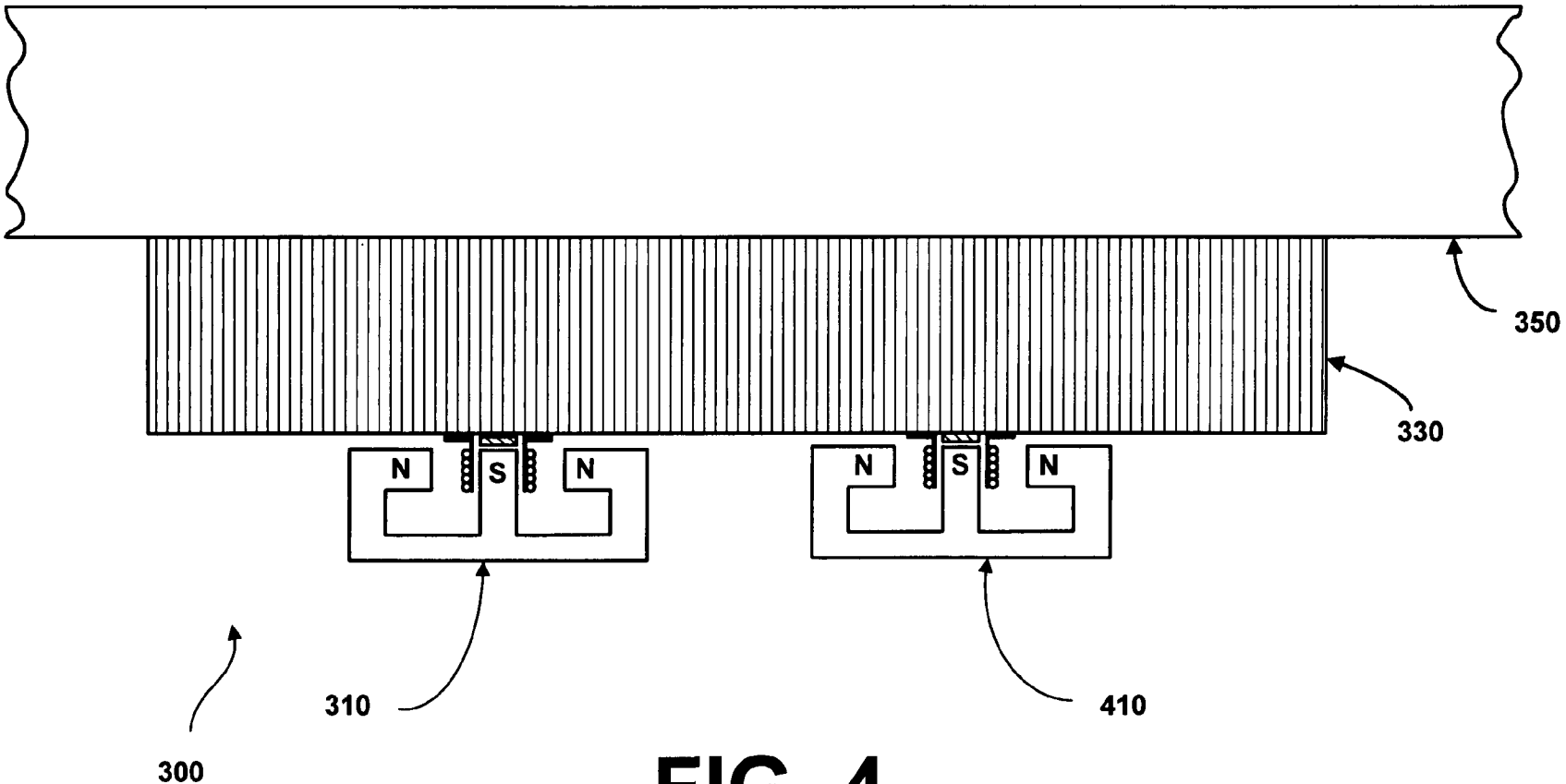
FIG. 4 is a schematic diagram illustrating a speaker in accordance with a second exemplary embodiment of the invention.

In accordance with a second exemplary embodiment of the invention, the speaker may have more than one exciter connected to the transparent sound panel via the dampening pad and the stiff panel. FIG. 4 is a schematic diagram illustrating a speaker in accordance with the second exemplary embodiment of the invention.

As is shown by FIG. 4, the speaker 300 contains a first exciter 310, a second exciter 410, and a transparent sound panel 350. In addition, a stiff panel 330, which is made of a rigid material, may be located between the first exciter 310 and the transparent sound panel 350, and between the second exciter 410 and the transparent sound panel 350. As with the first embodiment, the first and second exciters 310, 410 of the second embodiment, both have a dampening pad and a voice coil, where the dampening pads may be located central to the respective voice coils associated with the respective exciters. In addition, the dampening pads are connected to the stiff panel 330.

It should be noted that more exciters may be located within the present speaker. In addition, the exciters may be connected to different locations of the stiff panel.

The present speaker may also be used within a sound system focused on improving sound quality of the speaker. As an example, the present speaker may be used in combination with a full range speaker having most of the midrange input to the full range speaker removed. The midrange input to the full range speaker may be removed by inserting a wideband midrange notch filter in a preamplifier stage of an amplifier driving the full range speaker. One having ordinary skill in the art would understand how to perform the above-mentioned modifications to a full range speaker in order to have most of a midrange input to the full range speaker removed.

Figure 5:
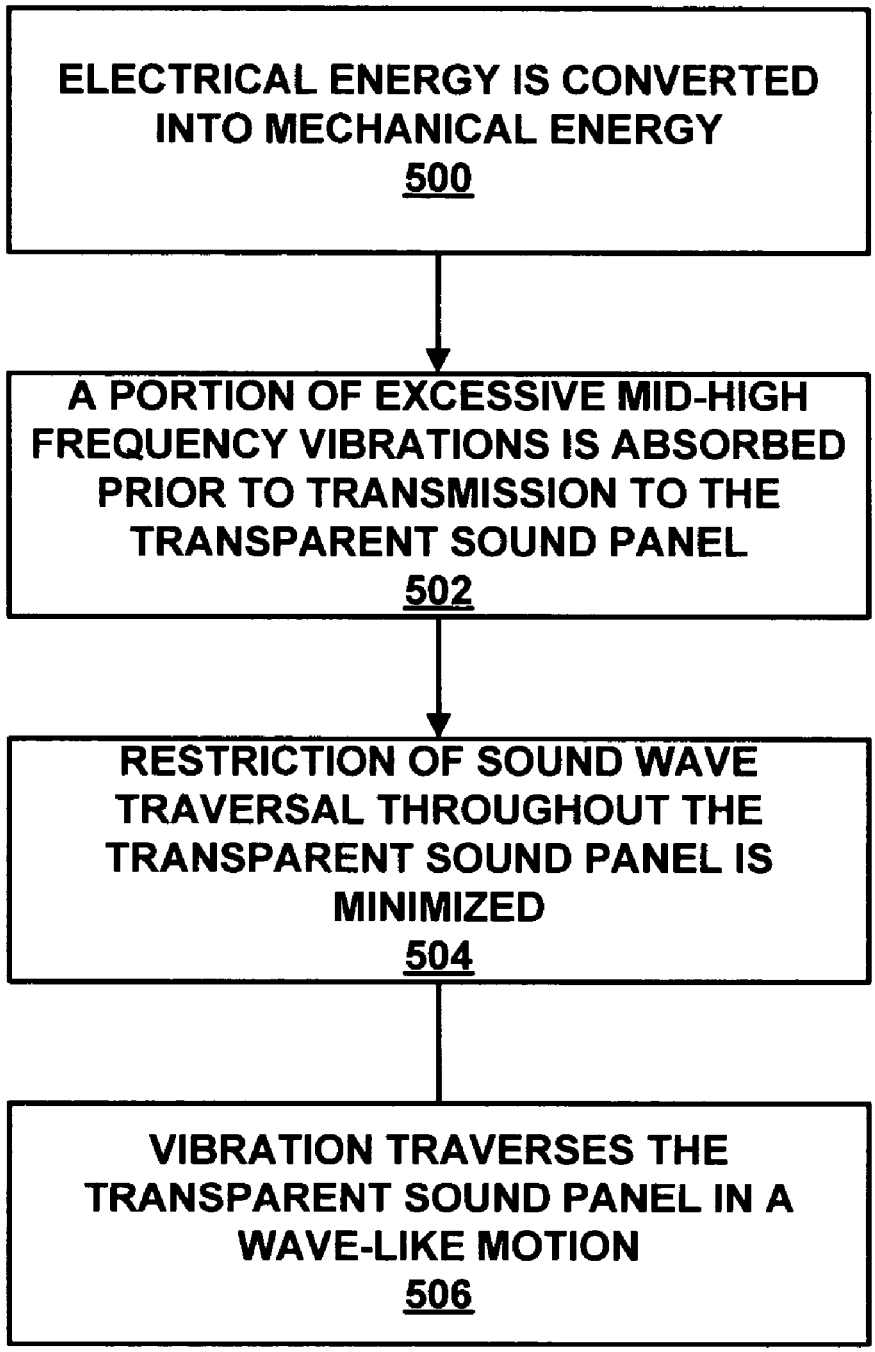
FIG. 5 is a flowchart illustrating the architecture, functionality, and operation of a possible implementation of the speaker of FIG. 2.

FIG. 5 is a flowchart illustrating the architecture, functionality, and operation of a possible implementation of the speaker of FIG. 2. In this regard, each block represents a module or segment, which comprises one or more executable instructions for implementing the specified function(s). It should also be noted that in some alternative implementations, the functions noted in the blocks may occur out of the order noted in the flow charts. For example, two blocks shown in succession may in fact be executed substantially concurrently or the blocks may sometimes be executed in the reverse order, depending upon the functionality involved, as will be further clarified hereinbelow.

Referring to FIG. 5, electrical energy is converted into mechanical energy (block 500). Specifically, as mentioned above, when electrical energy, such as current, is flowing through the voice coil 212, a magnetic field generated in the voice coil 212 interacts with the magnetic field of the magnetic structure 220. This interaction results in an upward and downward vibration motion of the voice coil 212, frequency of which depends on waveform of the received electrical signal. It is based upon this vibration motion that the received electrical energy is converted into mechanical energy.

A portion of excessive mid-high frequency vibrations is absorbed prior to transmission to the transparent sound panel 250 (block 502). As mentioned above, the dampening pad 240 performs this absorption. Use of the dampening pad 240 results in high pitch sound transmitted from the speaker 200 having less overshoot in waveform of the speaker 200. As is shown by block 504, the restriction of sound wave traversal throughout the transparent sound panel 250 is minimized. As is mentioned above, the stiff panel 230 performs the minimizing of restriction. As is shown by block 506, vibration traverses the transparent sound panel 250 in a wave-like motion resulting in sound heard by a user.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A speaker, comprising:

a transparent sound panel;

an exciter connected to said transparent sound panel, said exciter for converting received electrical energy into vibrations that are transmitted to said transparent sound panel, resulting in said transparent sound panel transmitting sound, wherein said exciter further comprises a voice coil and a magnetic structure;

a stiff panel located between said exciter and said transparent sound panel; and a dampening pad located within said exciter adapted to absorb a portion of excessive mid-high frequency vibrations emanating from said exciter prior to transmission to said transparent sound panel, wherein said dampening pad is connected to both said stiff panel and said voice coil and is located within a diameter of said exciter.

2. The speaker of claim 1, wherein said stiff panel minimizes dampening qualities associated with material utilized to fabricate said transparent sound panel and minimizes bending of a portion of said transparent sound panel that is in contact with said stiff panel.

3. The speaker of claim 1, wherein said exciter is an electromechanical transducer.

4. The speaker of claim 3, wherein said exciter is selected from the group consisting of a piezoelectric exciter an electromagnetic exciter.

5. The speaker of claim 1, wherein said transparent sound panel is fabricated from material comprising polycarbonate.

6. The speaker of claim 1, wherein said transparent sound panel is fabricated from material comprising polypropylene.

7. The speaker of claim 1, wherein said transparent sound panel is fabricated from material comprising acrylic.

8. The speaker of claim 1, wherein said transparent sound panel is fabricated from material comprising polycarbonate.

9. The speaker of claim 1, wherein said transparent sound panel is fabricated from material comprising Polyvinyl chloride.

10. The speaker of claim 1, wherein said voice coil further comprises a cylindrical bobbin and a coil of conductive wire.

11. The speaker of claim 1, wherein said speaker comprises than one exciter.

12. The speaker of claim 1, wherein said exciter is ached to an edge of said stiff panel.

13. A system for producing sound comprising:

a first speaker having a transparent sound panel;

a full range speaker configured to remove a portion of a midrange input to said full range speaker, while simultaneously maintaining a high range input and a low range input to said full range speaker;

an exciter connected to said transparent sound panel, said exciter for converting received electrical energy into vibrations;

a stiff panel located between said exciter and said transparent sound panel, wherein said stiff panel minimizes dampening qualities associated with material utilized to fabricate said transparent sound panel and minimized bending of a portion of said transparent sound panel that is in contact with said stiff panel; and a dampening pad located within said exciter for absorbing a portion of excessive mid-high frequency vibrations emanating from said exciter, wherein said dampening pad is connected to both said stiff panel and said exciter and wherein said dampening pad is located within a diameter of said exciter.

14. A method of transmitting sound via a transparent sound panel, comprising the steps of:

converting electrical energy into mechanical energy;

absorbing a portion of excessive mid-high frequency vibrations prior to transmission to said transparent sound panel; and minimizing restriction of sound wave traversal throughout said transparent sound panel, prior to said sound wave traversal throughout said transparent sound panel, wherein a stiff panel is disposed proximate the transparent sound panel to minimize the restriction of sound wave traversal, wherein a dampening pad is connected to said stiff panel to absorb the excessive mid-high frequency vibrations, and wherein an exciter is connected to both said stiff panel and said dampening pad disposed therebetween and said exciter is configured to encircle said dampening pad.

15. The method of claim 14, further comprising the step of transmitting said sound wave from said transparent sound panel.

16. A speaker, comprising:

means for converting electrical energy into mechanical energy;

means for absorbing a portion of excessive mid-high frequency vibrations prior to transmission to a transparent sound panel; and means for minimizing restriction of sound wave traversal throughout said transparent sound panel, prior to said sound wave traversal throughout said transparent sound panel, wherein a stiff panel is disposed proximate the transparent sound panel to minimize the restriction of sound wave traversal, wherein a dampening pad is connected to said stiff panel to absorb the excessive mid-high frequency vibrations, and wherein an exciter is connected to both said stiff panel and said dampening pad disposed therebetween and said exciter is configured to encircle said dampening pad.

17. The speaker of claim 16, further comprising means for providing said electrical energy to said means for converting electrical energy into mechanical energy.

* * * * *